United States Patent [19]

Musetti

[11] Patent Number: 4,809,715

[45] Date of Patent: Mar. 7, 1989

[54] POCKET ASHTRAY

[76] Inventor: Louis J. Musetti, 480 Hoffman Ave., Monterey, Calif. 93940

[21] Appl. No.: 76,897

[22] Filed: Jul. 23, 1987

[51] Int. Cl.[4] ..... A24F 13/18

[52] U.S. Cl. ..... 131/256; 131/235.1; 131/237

[58] Field of Search ..... 131/256, 235.1, 237

[56] References Cited

U.S. PATENT DOCUMENTS 450,312 4/1891 Hietzman ..... 131/256

2,715,961 8/1955 Field ..... 131/256

FOREIGN PATENT DOCUMENTS 0580096 7/1933 Fed. Rep. of Germany ..... 131/256

*Primary Examiner*—V. Millin

*Attorney, Agent, or Firm*—Sanford Astor

[57] ABSTRACT

The invention relates to a pocket ashtray in which a cigarette, cigar or other burning material is extinguished by means of insertion into a two part cylindrical tube, sealed at one end, thereby depleting the oxygen level in the tube, and enabling the rapid extinguishing of cigarettes, or other burning material. The unit also embodies a clip similar to a pen, for convenient carrying, and one part of the tube constitutes an ejection tube for removal of material in the cylindrical tube.

11 Claims, 1 Drawing Sheet

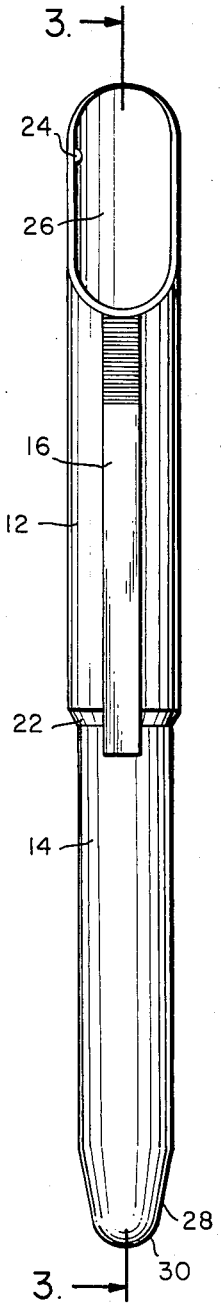
Fig. 2.
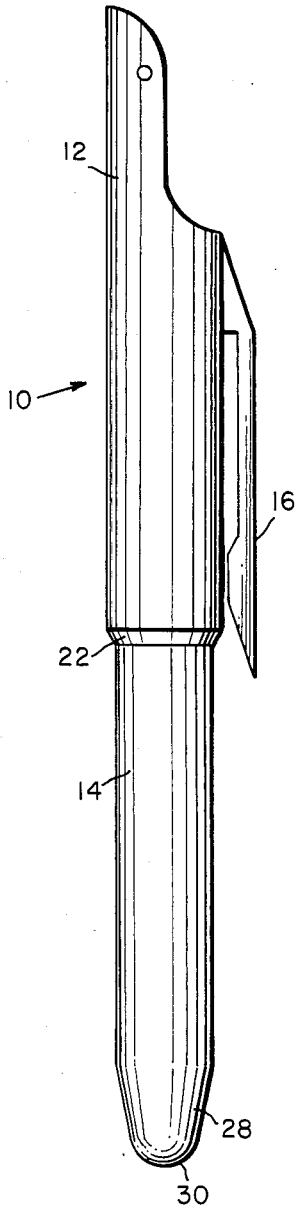
Fig. 1.
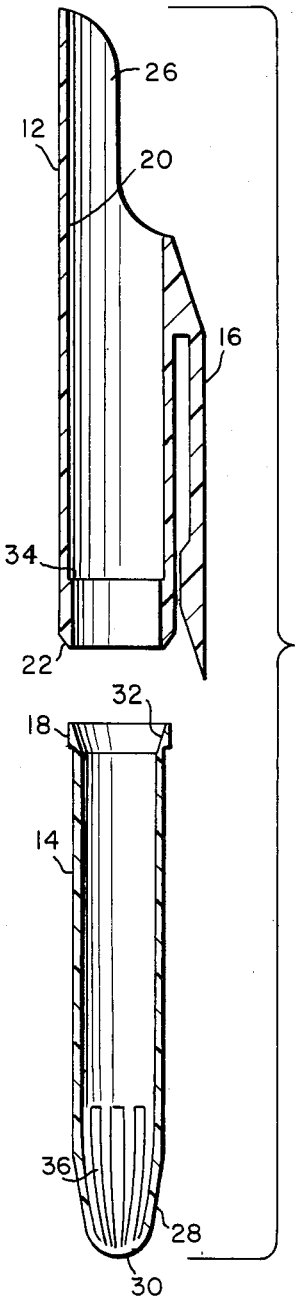
Fig. 3.
Fig. 4.
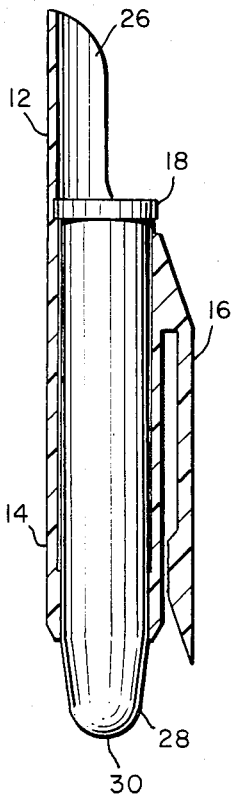

POCKET ASHTRAY

BACKGROUND OF THE INVENTION

The present invention relates generally to a "pocket", or portable extinguisher for cigarettes and other burning materials. Smokers are often caught in the position of being in a location where they must quickly extinguish their cigarette or cigar and where there is no convenient receptacle to do so. Also, they may wish to extinguish it for the moment and relight it later.

Devices that have been known in the prior art are generally small boxes with lids, and are difficult to carry around by the person desiring to utilize the device.

It is the object of the present invention to provide a convenient, clean and safe receptacle for extinguishing cigarettes and like materials or any other burning material that is portable, convenient and inexpensive.

Yet another object of the invention is to provide a portable, yet simple smoke extinguisher that can be worn by persons who are in the habit of smoking.

DESCRIPTION OF THE INVENTION

These and other objects of the invention will be disclosed by reference to the drawings in which:

FIG. 1 is a front view of the device of the present invention;

FIG. 2 is a side view of the device;

FIG. 3 is a section view, showing the internal structure;

FIG. 4 is a fully collapsed view of the device of the present invention.

Referring now to the figures, there is shown the smoke extinguisher (10) of the present invention comprising an upper tube (12) and a lower tube (14). The upper tube (12) has a clip (16) fixedly attached thereto, or in the alternative, if the part is molded as one part, the clip (16) is molded as part of the upper tube (12).

The lower tube (14) is slightly smaller in diameter compared to the upper tube (12), and contains a head or lip portion (18) which is slightly larger in diameter than the lower tube (14). As shown in FIGS. 3 and 4, this lip portion (18) fits inside of the inner diameter (20) of the upper tube (12) and is adapted to rest against a constricted diameter or flange portion (34) a distance above the lower end (22) of upper tube (12). Since the outer diameter of the lip portion (18) of lower tube (14) is larger than the diameter of the flange (34) the lip (18) prevents the lower tube (14) from falling out of the upper tube (12). The lower edge (22) of upper tube (12) is tapered.

A detent (24) at the upper portion of tube (12) internally acts as a stop to prevent the lower tube (14) from passing through the opening (26) of upper tube (12). As can be seen, both tubes are hollow, upper tube (12) being open at both ends and lower tube (14) being open only at the upper end. The lower end (28) of lower tube (14) tapers to a rounded point (30).

The detent (24) prevents the lower tube (14) from falling out of the upper tube (12) through the opening (26) when the device is tipped over for cleaning. The detent (24) also keeps the assembly together during handling and shipping.

Clip (16) can be used to hold the device to a pocket or other narrow surface even while the lower tube (14) is pushed up for ejection of the cigarette or other material in the tube.

The lip (18) of lower tube (14) has a tapered inner diameter (32) which provides for easy entry of the cigarette or other material preventing hang-ups. Lip (18) also causes the inner walls of upper tube (12) to be scraped clean when lower tube (14) is pushed up for ejection. The entire lower tube (14) tapers slightly to a smaller diameter from the head end (18) to the pointed end (30) which aids in fast extinguishing time for the cigarette. The pointed end (28) of tube (14) contains internal ribs (36), which act as a heat sink and again also aid in a fast extinguishing time for the cigarette.

The pointed end (30) of tube (14) being relatively solid, due to ribs (36), contains extra weight, which aids in returning the part (14) to its extended position after it has been pushed up into the upper tube (12) for ejection of the material inside.

The lip end (18) of lower tube (14) rests against the constricted inner diameter (34) of upper tube (12) a short distance from the end (22) of the upper tube (12). This short distance of overlapping of upper tube (12) and lower tube (14) is important to keep the two portions of the tube in alignment. If lip (18) of lower tube (14) rested against the flange (22) of upper tube (12) there would be little contact between the two tubes and they would easily move out of alignment.

In use, if a smoker wants to extinguish his cigarette and if desired, relight it later, he can place the cigarette into the open top slot (26) of top tube (12), lighted end down, and let it drop into the lower end (28) of lower tube (14). The lack of oxygen puts the cigarette out very quickly and it can remain in that location until the smoker wishes to relight the cigarette. When he wishes to do so, he simply pushes up on lower tube (14) pushing it up into upper tube (12) and when the two tubes (12) (14) are fully collasped, the cigarette is ejected from upper tube (12).

In addition, the unit is boxed and shipped in a fully collapsed position, shown in FIG. 4, for saving space.

The unit of the present invention is made of a length to handle a standard cigarette for example, and even though the cigarette may be smoked part way down, when it is placed into the open slot (26) of the upper tube (12) and falls down to the bottom of the lower tube (28), when the lower tube (14) is collapsed and pushed up into the upper tube (12) a part of the cigarette will still emerge from lower tube (14) so that it can be retrieved or discarded. The assembly of the present invention can be made from any convenient material, usually a high impact plastic, such as a polystyrene or any other convenient hard plastic.

The upper end (26) of upper tube (12) is cut at an angle to the horizontal, providing an easy, wide opening for insertion of the cigarette.

Having thus described the invention, it is requested that the patent be limited only by the scope of the appended claims.

I claim:

1. A device for extinguishing burning materials comprising an upper tube and a lower tube engaged one over the other, said upper tube open at both ends with no obstructions in its interior, said lower tube open at one end and sealed at the other end, the upper tube having a diameter larger than the lower tube so that the upper tube slides frictionally over the lower tube, means to prevent the lower tube from disengaging from the upper tube.

2. The device of claim 1 in which the lower tube contains a ribbed lower chamber, which acts as a heat sink to help extinguish the burning material.

3. The device of claim 1 in which the upper end of the upper tube is cut at an angle to the horizontal to provide easy access for the burning material.

4. The device of claim 1 in which the upper tube also contains a pocket clip.

5. The device of claim 1 in which the means to prevent the lower tube from disengaging the upper tube comprises a lip of a larger diameter at the upper end of the lower tube and a constricted diameter at the lower end of the upper tube.

6. The device of claim 1 in which the means to prevent the lower tube from disengaging the upper tube also includes a detent to prevent the lower tube from disengaging from the upper end of the upper tube.

7. The device of claim 1 in which the lower tube contains a weighted lower end to aid in returning the lower end to its extended position.

8. A device for extinguishing burning materials such as a cigarette or cigar comprising an upper tube and a lower tube engaged one over the other, said upper tube open at both ends with no obstructions in its interior, said lower tube open at one end and sealed at the other end, the upper tube having a diameter larger than the lower tube so that the upper tube slides frictionally over the lower tube, wherein the upper end of the upper tube is cut at an angle to the horizontal, wherein the upper tube has a pocket clip, a lip of a larger diameter at the upper end of the lower tube, a constricted diameter at the lower end of the upper tube so that said lip engages said constricted diameter to prevent the lower tube from disengaging from the upper tube, a detent at the upper end of the upper tube located on the inside surface of the upper tube to prevent the lower tube from disengaging from the upper tube, in which the lower end of the lower tube is weighted internally by a series of longitudinal ribs.

9. The device of claim 8 in which the lip at the upper end of the lower tube is tapered internally.

10. The device of claim 8 in which the constricted diameter of the upper tube extends a distance from the lower end of the upper tube.

11. The device of claim 8 in which the lower tube tapers slightly to a rounded point at the closed end.

* * * * *